US010440802B1

(12) United States Patent
Lin et al.

(10) Patent No.: US 10,440,802 B1
(45) Date of Patent: Oct. 8, 2019

(54) LIGHTING CONTROL SYSTEM AND METHOD

(71) Applicant: ADATA TECHNOLOGY CO., LTD., New Taipei (TW)

(72) Inventors: Sheng-Tsung Lin, New Taipei (TW); Yung-Hsing Yin, New Taipei (TW)

(73) Assignee: ADATA TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/173,093

(22) Filed: Oct. 29, 2018

(30) Foreign Application Priority Data

Jul. 20, 2018 (TW) ..... 107125144 A

(51) Int. Cl.
*H05B 37/02* (2006.01)
*F21V 23/04* (2006.01)
*F21V 23/00* (2015.01)

(52) U.S. Cl.
CPC ..... *H05B 37/0254* (2013.01); *F21V 23/005* (2013.01); *F21V 23/0435* (2013.01)

(58) Field of Classification Search
CPC ..... H05B 37/0254; F21V 23/0435; F21V 23/005; F21V 23/006
See application file for complete search history.

(56) References Cited

U.S. PATENT DOCUMENTS

| | | | | |
|---|---|---|---|---|
| 9,953,552 | B2 * | 4/2018 | Yuan | G09F 9/33 |
| 2010/0029268 | A1 * | 2/2010 | Myer | F21S 2/00 455/426.1 |
| 2013/0193847 | A1 * | 8/2013 | Recker | H05B 33/0803 315/86 |
| 2013/0320855 | A1 * | 12/2013 | Hulett | H05B 33/0842 315/113 |
| 2016/0286629 | A1 * | 9/2016 | Chen | H05B 37/0272 |
| 2018/0090059 | A1 * | 3/2018 | Baroughi | G09G 3/006 |

* cited by examiner

*Primary Examiner* — Alan B Cariaso
(74) *Attorney, Agent, or Firm* — Li & Cai Intellectual Property (USA) Office

(57) ABSTRACT

A lighting control system and a method thereof are provided. The lighting control system includes a light board and a mainboard. The light board includes a light-emitting module, transmission interfaces and a lighting control module. The mainboard outputs interface testing signals to inquire which types of the transmission interfaces are supported by the light board. The transmission interfaces output interface message signals in response to the interface testing signal. When the mainboard determines that the light board supports one or more types of the transmission interfaces indicated by the interface testing signal, the mainboard selects one of the transmission interfaces and instructs the selected transmission interface to control the light-emitting module. When the mainboard determines that the light board does not support any type of the transmission interfaces indicated by the interface testing signal, the mainboard instructs the lighting control module to control the light-emitting module.

7 Claims, 6 Drawing Sheets

LIGHTING CONTROL SYSTEM AND METHOD

CROSS-REFERENCE TO RELATED PATENT APPLICATION

This application claims the benefit of priority to Taiwan Patent Application No. 107125144, filed on Jul. 20, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a lighting control system and method, and more particularly to a lighting control system and method for status indicators of a computer host.

BACKGROUND OF THE DISCLOSURE

A computer can operate in a normal mode and a sleep mode such as a power saving mode. When the computer has not been used for a period of time, the computer automatically goes to sleep or the computer may be manually set into a mode such as the sleep mode by a user. Status indicators are usually used to display different operational states of the computer, and the display of the status indicators varies with the operational status of the computer. For example, two status indicators are disposed on a mainboard or a display of the computer. When the computer operates in the normal mode, one of the status indicators is continually lit, and another status indicator goes off. Conversely, when the computer operates in the sleep mode, the one status indicator goes off, and the another status indicator is continually lit. However, an interface card for controlling the conventional status indicator only has a single support interface, and specific types of transmission interfaces cannot be selected according to different requirements, which result in incompatibility in communication interfaces between a mainboard and the interface card.

SUMMARY OF THE DISCLOSURE

In response to the above-referenced technical inadequacies, the present disclosure provides a lighting control system including a light board and a mainboard. The light board includes a light emitting module, a plurality of transmission interfaces and a lighting control module. The light emitting module includes one or more light emitting units. The light emitting unit emits a light beam according to a received interface control signal or a received lighting control signal. The plurality of transmission interfaces are connected to the light emitting module. Each of the transmission interfaces responds to an interface message signal according to transmission interface information inquired by a received interface testing signal. When one of the transmission interfaces receives a host selecting control signal, the one transmission interface outputs the interface control signal to the light emitting module according to a host selecting control signal to control the light emitting module to emit the light beam. The lighting control module is connected to the light emitting module. When the lighting control module receives the host selecting control signal, the lighting control module outputs the lighting control signal to the light emitting module according to the host selecting control signal to control the light emitting module to emit the light beam. The mainboard is connected to the transmission interfaces and the lighting control module. The mainboard outputs the interface testing signals to the transmission interfaces respectively to inquire the transmission interface information of the transmission interfaces. When the mainboard determines that the light board supports one or more types of transmission interfaces indicated by the interface testing signals according to the interface message signals, the mainboard selects one of the supported transmission interfaces and outputs the host selecting control signal to the selected transmission interface. When the mainboard determines that the light board does not support any type of the transmission interfaces indicated by the interface testing signals according to the interface message signals, the mainboard outputs the host selecting control signal to the lighting control module.

The present disclosure provides a lighting control method, including the following steps: using a mainboard to output interface testing signals to a plurality of transmission interfaces of a light board to inquire transmission interface information of the transmission interfaces; using the transmission interfaces of the light board to respond interface message signals to the mainboard according to the transmission interface information inquired by the interface testing signals; using the mainboard to determine whether the light board supports one or more types of transmission interfaces indicated by the interface testing signals or not according to the interface message signals, in response to determine that the light board supports the one or more types of the transmission interfaces indicated by the interface testing signals, using the mainboard to select one of the supported transmission interfaces and output a host selecting control signal to the selected transmission interface, and using the selected transmission interface to output an interface control signal according to the host selecting control signal to a light emitting module; if the light board does not support one or more types of transmission interfaces indicated by the interface testing signals, using the mainboard to output the host selecting control signal to a lighting control module, and using the lighting control module to output a lighting control signal to the light emitting module; and using the light emitting module to emit a light beam according to the received interface control signal or lighting control signal.

As described above, the present disclosure provides a lighting control system and method, which drive the light emitting units as status indicators to emit the light beams, for example, by using the various interfaces such as the SMBUS interface and the USB interface supported by the light board and the lighting control system of the light board, according to operational states of circuit components such as a solid state disk in a computer host. Therefore, the present disclosure has an advantage of wide compatibility between the mainboard and the light board.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
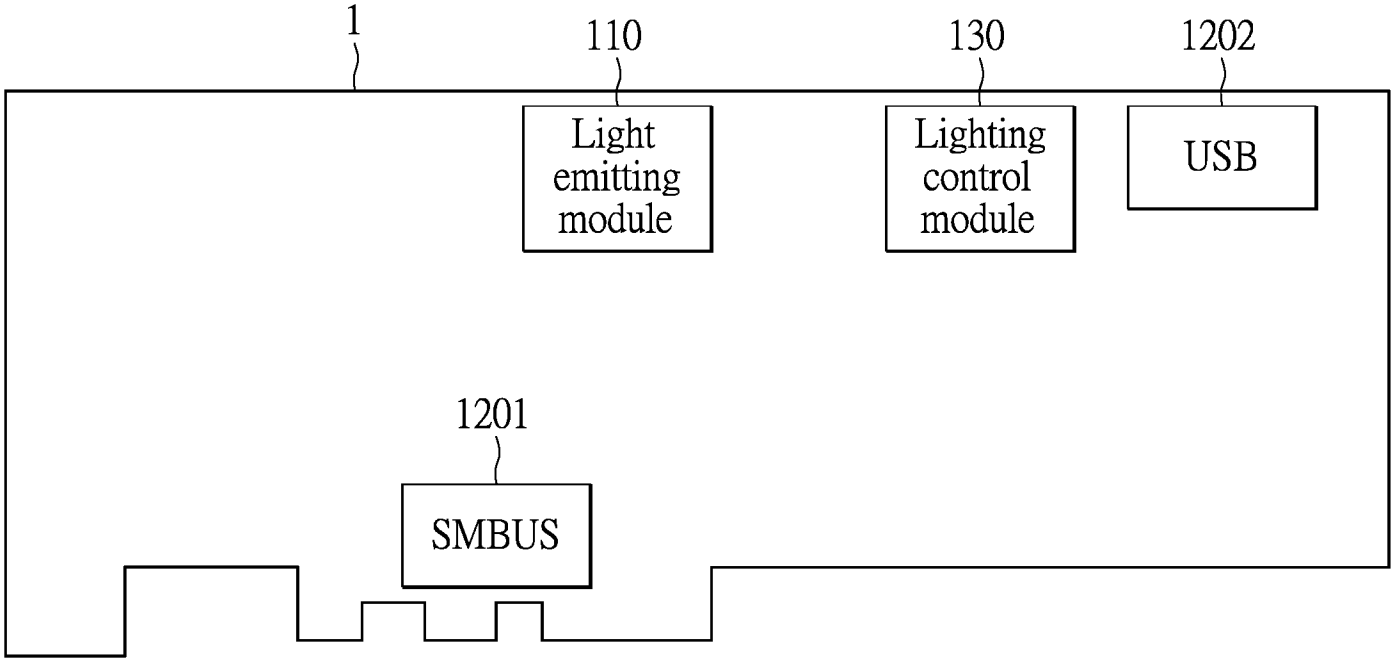
FIG. 1 is a block diagram of a light board of a lighting control system according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
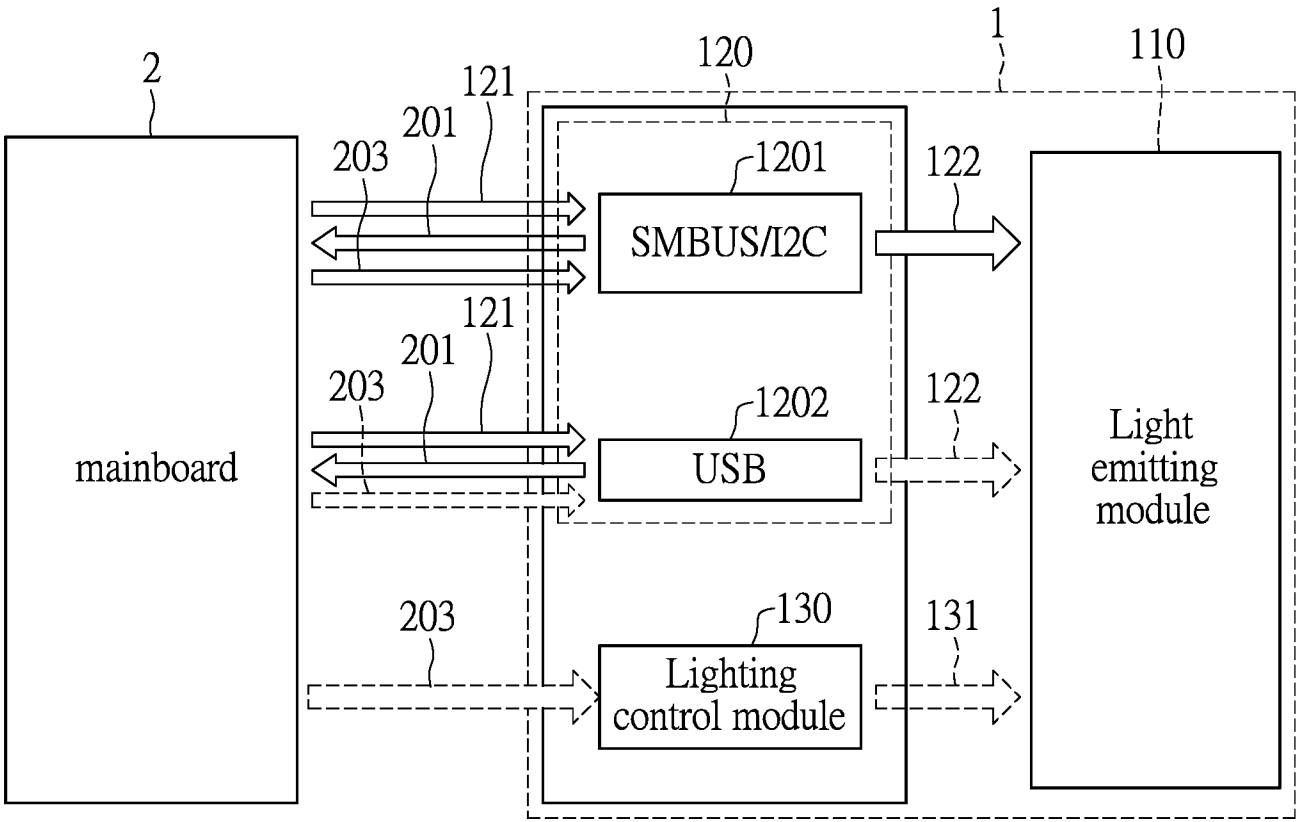
FIG. 2 is a block diagram of the lighting control system according to the first embodiment of the present disclosure.

Reference are made to FIGS. 1 and 2, wherein FIG. 1 is a block diagram of a light board of a lighting control system according to a first embodiment of the present disclosure; FIG. 2 is a block diagram of the lighting control system according to the first embodiment of the present disclosure. As shown in FIGS. 1 and 2, in the embodiment, the lighting control system includes a light board 1 and a mainboard 2. The light board 1 includes a lighting control module 110, a plurality of transmission interfaces 120, and a lighting control module 130. The transmission interfaces 120 and the lighting control module 130 are connected between the mainboard 2 and the lighting control module 110. It should be understood that the number of the components included in the lighting control system may be increased or reduced according to actual requirements, and the present disclosure is not limited thereto.

The transmission interfaces 120 may be different types or the same type of transmission interfaces. In the embodiment, the transmission interfaces 120 include an SMBUS/I2C 1201 and a USB 1202. In practice, the light board 1 may be integrated with different types of transmission interfaces 120, such as an eSATA or an IEEE 1394, etc., according to transmission requirements, and the present disclosure is not limited thereto.

The light emitting module 110 includes one or more light emitting units, each of which may be a status indicator of a computer host. The mainboard 2 is connected to the transmission interfaces 120 and the lighting control module 130 through transmission wires. In addition, the mainboard 2 may be connected to other circuit components in the computer host such as a power supply or a solid state drive through connection ports. The mainboard 2 may select one or more control elements or mediums for the light emitting units from the transmission interfaces 120 and the lighting control module 130 according to operating states of the components in the computer host. The selected transmission interface 120 or lighting control module 130 may be used to control the light emitting unit 110 to emit light beams in different illuminating states (which includes illuminating colors, illuminating time intervals, and flicker frequencies) in response to the operating states of the internal components of the computer host or the peripheral devices. For example, the light emitting units may be light emitting diodes for emitting the light beams having the same or different colors, such as a red light, a blue light, and a green light, etc.

When the mainboard 2 detects the operating states of the components in the computer host, for example, the power supply is switched from a normal mode to a power saving mode, the mainboard 2 may determine signal transmission manner to be used between the mainboard 2 and the transmission interface 120 or the lighting control module 130, according to the type of the transmission interface supported by the mainboard 2 and the type of the detected component/device, for example, the type of the transmission interface 120 having a faster transmission speed used for important components in the computer host. That is, if the illuminating states of the light emitting modules 110 need to be changed with the operating states of the circuit components detected by the mainboard 2 at the same time point, the mainboard 2 may determine a signal transmission order of various types of transmission interfaces 120 based on factors such as the importance of the components/devices and an order of time points at which the operating state changes.

It is worth noting that, in the embodiment, in addition to the lighting control module 130 of the light board 1, the transmission interfaces 120 disposed additionally are used as transmission mediums between the mainboard 2 and the light emitting module 110 and used as control elements of the light emitting module 110. Different operating manners of the transmission interfaces 120 and the lighting control module 130 are described below.

The mainboard 2 may output interface testing signals 201 to the transmission interfaces 120 of the light board 1 respectively to test/inquire transmission interface information of the transmission interfaces 120 that includes the types of the transmission interfaces 120 supported by the light board 1. When the transmission interfaces 120 receives the interface testing signals 201 from the mainboard 2 respectively, the transmission interfaces 120 respond interface message signals 121 respectively to the mainboard 2 according to the transmission interface information inquired by the interface testing signals 201, such that the mainboard 2 may obtain the types of the transmission interfaces 120 supported by the light board 1.

Further, the mainboard 2 receives the interface message signals 121 from the transmission interfaces 120 of the light board 1. When the mainboard 2 determines whether the light board 1 supports one or more types of the transmission interface indicated by the interface testing signals 201, that is, determining whether the light board 1 supports an application program of the mainboard 2, according to the interface message signals 121 from the transmission interfaces 120, the mainboard 2 may select one of the supported transmission interfaces 120 and then output a host selecting control signal 203 to the selected transmission interface 120.

If the mainboard 2 outputs the interface testing signals 201 indicating more than one type of the transmission interfaces 120, the mainboard 2 may output the interface testing signals 201 to the transmission interfaces 120 in a desired order of using the multiple types of the transmission interfaces. When the mainboard 2 determines the types of the transmission interfaces indicated by the interface testing signals 201 and supported by the light board 1, the mainboard 2 may select a transmission interface 120 of the highest priority among the supported transmission interfaces 120 according to the desired order. After selecting the transmission interface 120 from the transmission interfaces 120 of the light board 1, the mainboard 2 outputs the host selecting control signal 203, which is marked by a solid arrow in FIG. 2, to the selected transmission interfaces 120. In the embodiment, although the transmission interface 120 currently selected by the mainboard 2 is the SMBUS/I2C 1201, the mainboard 2 may also select other types of the transmission interface 120 or the lighting control module 130 by the host selecting control signals 203 marked in FIG. 2 as dashed arrows according to actual requirements. Details in connection with the lighting control module 130 will be further described below.

In addition to the type of the transmission interface, the mainboard 2 is also able to take into consideration other factors such as a transmission manner, a transmission rate and a state of current usage of each of the transmission interfaces 120 indicated by each of the interface message signals 121 to select one of the transmission interfaces 120. For example, the transmission interface 120 with a smaller transmission rate is selected for signal transmission, such that each of the transmission interfaces 120 has an assigned usage rate. For example, the transmission interfaces can have substantially the same transmission rate, or have different transmission rates according to the types of the transmission interfaces 120 having different characteristics.

Further, when the transmission interface 120 of the light board 1 that is selected by the mainboard 2 receives the host selecting control signal 203, the transmission interface 120 obtains the operational state of the circuit component to be displayed, such as a storing state of a solid state disk, according to the host selecting control signal 203 from the mainboard 2. The selected transmission interface 120 may output an interface control signal 122 such as a pulse width modulation signal according to the obtained operational state of the circuit component to the light emitting module 110 to control the light emitting module 110 to emit the light beam in an illuminating state corresponding to the operational state of the circuit component.

For convenience of description, two different terms "interface control signal 122" and "host selecting control signal 203" are used herein. It should be understood that the transmission interface 120 may be used only as a medium/component for transmitting the host selecting control signal 203 to the light emitting module 110 from the mainboard 2, wherein the host selecting control signal 203 is the same as the interface control signal 122.

Conversely, when the mainboard 2 determines that the light board 1 does not support any type of the transmission interfaces indicated by the mainboard 2 according to the interface message signals 121 from the transmission interfaces 120 of the light board 1, the mainboard 2 outputs the host selecting control signal 203 to the lighting control module 130. The lighting control module 130 outputs a lighting control signal 131 according to the host selecting control signal 203 from the mainboard 2 to the light emitting module 110 to control the light emitting module 110 to emit the light beam. The host selecting control signal 203 may include hardware operational state information including power on, power off, communication connections and other operational states. The lighting control module 130 may determine an illuminating state of the light emitting module 110 according to the obtained hardware operational state and output the corresponding lighting control signal 131.

Figure 3:
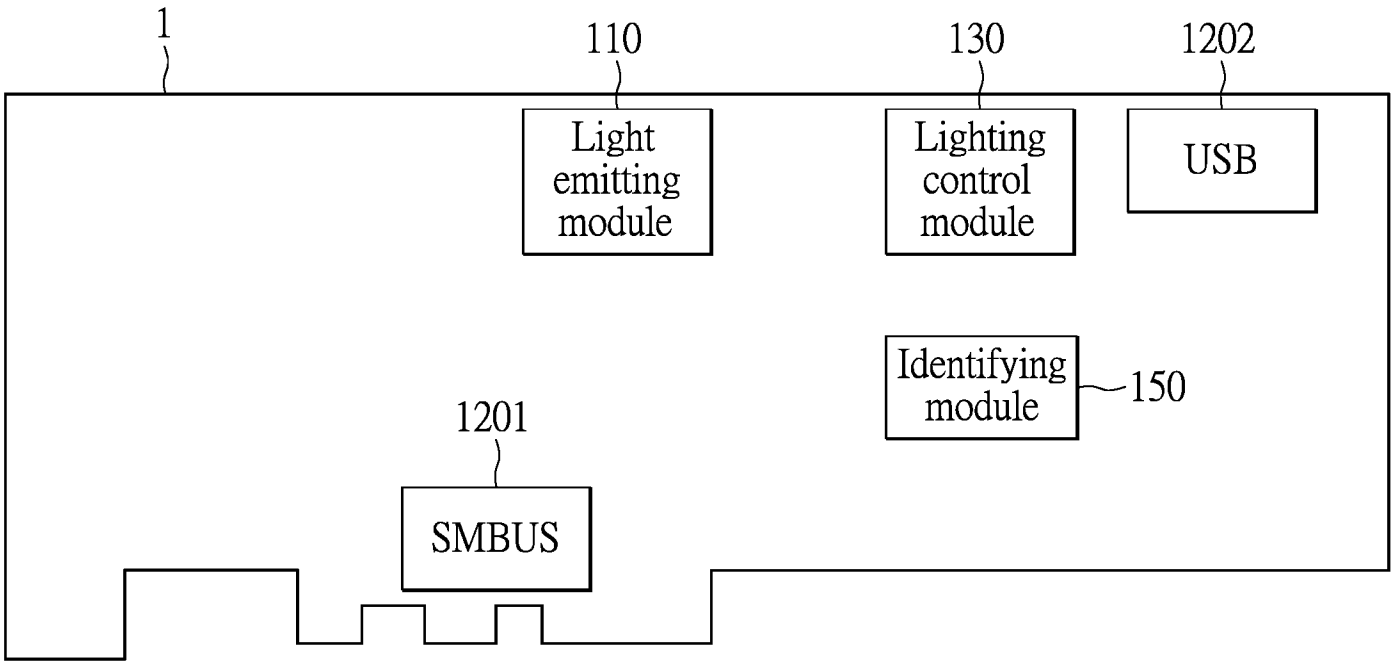
FIG. 3 is a block diagram of a light board of a lighting control system according to a second embodiment of the present disclosure.
Figure 4:
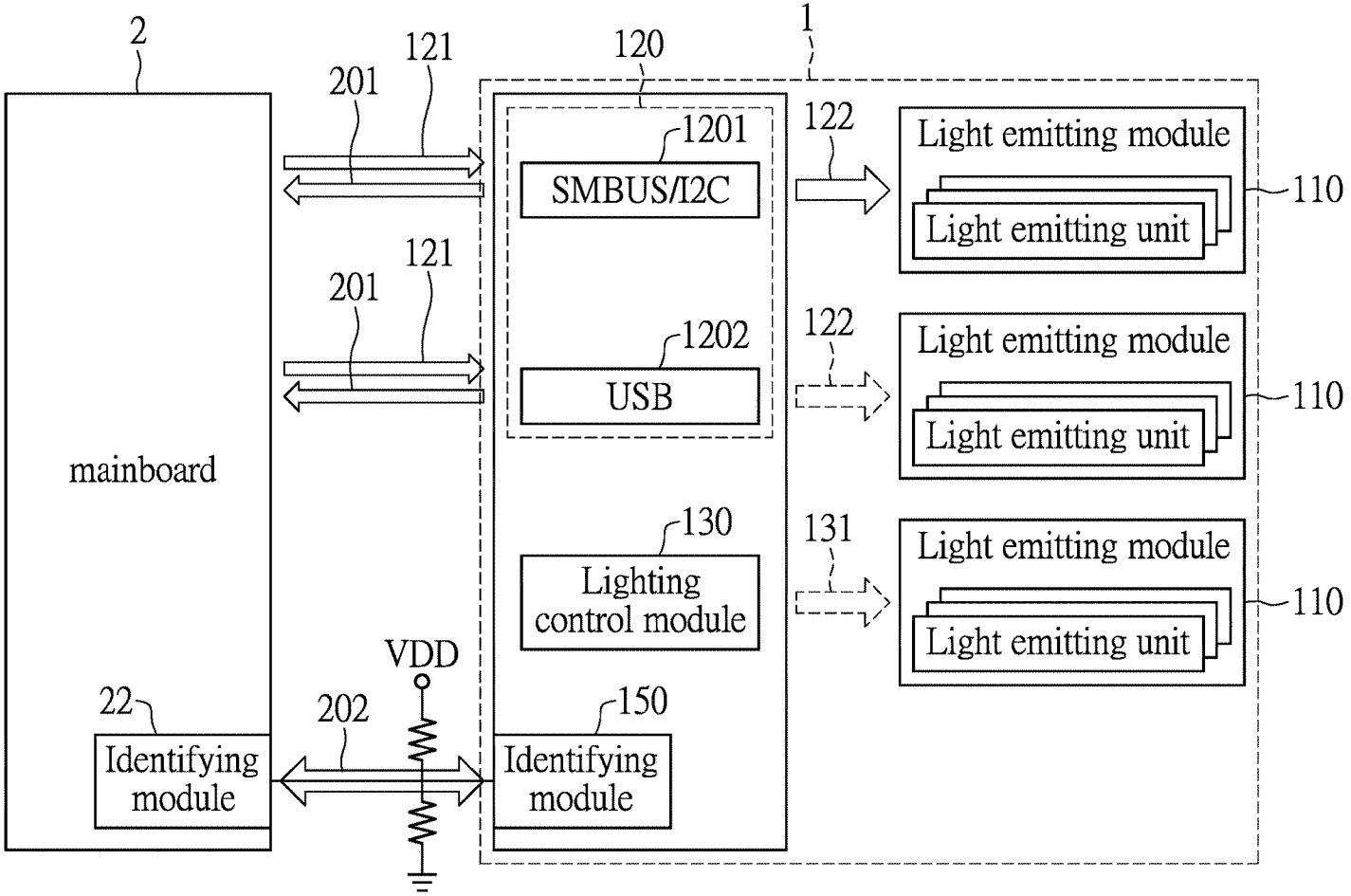
FIG. 4 is a block diagram of the lighting control system according to the second embodiment of the present disclosure.

Reference made are FIGS. 3 and 4, wherein FIG. 3 is a block diagram of a light board of a lighting control system according to a second embodiment of the present disclosure; FIG. 4 is a block diagram of the lighting control system according to the second embodiment of the present disclosure.

The second embodiment may be combined with the first embodiment according to the actual requirements. As shown in FIGS. 3 and 4, in the embodiment, the lighting control system includes the light board 1 and the mainboard 2. The light board 1 includes the plurality of light emitting modules 110, the plurality of transmission interfaces 120, the lighting control module 130 and an identifying module 150. The identifying module 150 is connected to the transmission interfaces 120 and the lighting control module 130. The light emitting modules 110 are connected to the transmission interfaces 120. The mainboard 2 includes an identifying module 22 connected to the identifying module 150 of the light board 1.

The identifying module 150 of the light board 1 may store different voltage values, which correspond to the transmission interfaces 120 and the lighting control module 130, respectively. After the mainboard 2 selects one of the transmission interfaces 120 and the lighting control module 130, the identifying module 22 of the mainboard 2 may output a voltage identifying signal 202 having a voltage corresponding to the selected transmission interface 120 or lighting control module 130. When the identifying module 150 of the light board 1 receives the voltage identifying signal 202 from the mainboard 2, the identifying module 150 of the light board 1 determines which one of the transmission interfaces 120 and the lighting control module 130 is selected by the mainboard 2 as a transmission medium according to the voltage of the voltage identifying signal 202. After determining the transmission medium, the identifying module 150 of the light board 1 outputs the identifying signal to the selected transmission interfaces 120 and the lighting control module 130 by the mainboard 2 to instruct the selected transmission interface 120 or lighting control module 130 to control the light emitting module 100 to emit the emit beam.

Alternatively, the identifying module 150 may store different voltage ranges, which correspond to the transmission interfaces 120 and the lighting control module 130 respectively. The mainboard 2 may receive a voltage signal, for example, a low power signal representing a power-saving mode or a high power signal representing a normal operating mode, from a circuit component such as a central processing unit having an operational state to be displayed. The mainboard 2 may select one of the transmission interfaces 120 and the lighting control module 130 as the transmission medium according to the voltage signal. The identifying module 22 of the mainboard 2 then outputs the voltage identifying signal 202 having a voltage falling within the voltage range corresponding to the selected transmission medium. For example, the identifying module 22 of the mainboard 2 outputs the voltage identifying signals 202 each having the voltage falling within a largest voltage range such as 0V to 12V. The mainboard 2 divides the largest voltage range into a plurality of sub-voltage range values, which correspond to the transmission interfaces 120 and the lighting control module 130 respectively. The identifying module 150 of the light board 2 stores the sub-voltage range values. The sub-voltage range values may include 0V to 3V, 3V to 6V (a lower limit value of which is not included), 6V to 9V (a lower limit value of which is not included) and 9V to 12V (a lower limit value of which is not included), but the present disclosure is not limited thereto. When the identifying module 150 of the light board 1 receives the voltage identifying signal 202 from the mainboard 2, the identifying module 150 of the light board 1 compares the voltage of the voltage identifying signal 202 with the voltage ranges and determines which one of the transmission mediums is selected by the mainboard 2 according to which of the voltage ranges the voltage of the voltage identifying signal 202 falls in.

Figure 5:
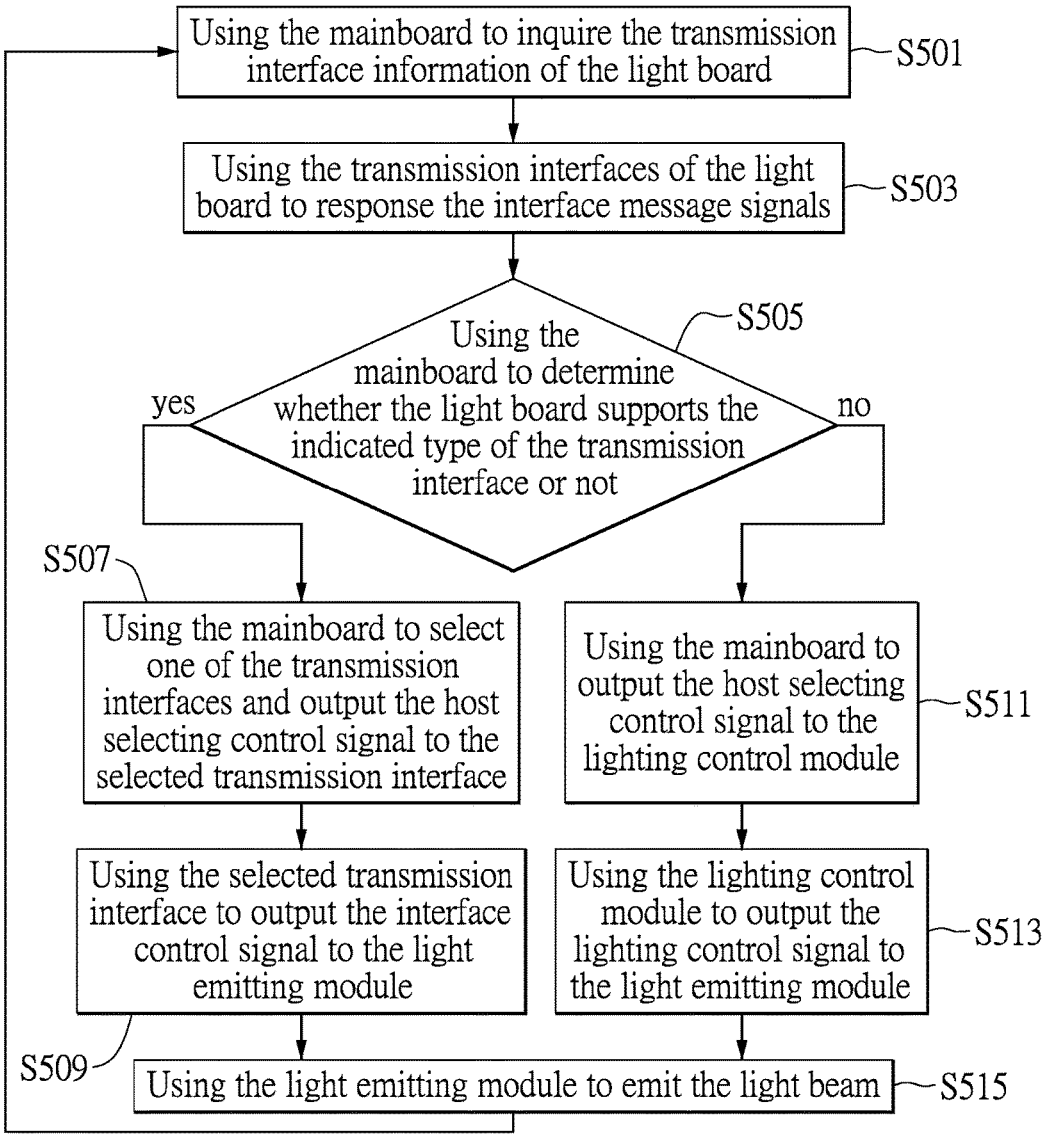
FIG. 5 is a flowchart of a lighting control method according to a third embodiment of the present disclosure.

Reference is made to FIG. 5, which is a flowchart of a lighting control method according to a third embodiment of the present disclosure. As shown in FIG. 5, in the third embodiment, the lighting control method includes the following steps S501 to S515 for the above lighting control system.

In step S501, the mainboard outputs the interface testing signals to the transmission interfaces of the light board respectively to inquire the transmission interface information of the transmission interfaces such as the types of the transmission interfaces supported by the light board.

In step S503, the transmission interfaces of the light board responds to the interface message signals according to the transmission interface information inquired by the received interface testing signals to the mainboard.

In step S505, the mainboard determines whether the transmission interfaces of the light board supports the one or more types of the transmission interfaces indicated by the interface testing signals according to the interface message signals. If the light board supports one or more types of the transmission interfaces indicated by the interface testing signals, the mainboard selects one of the supported transmission interfaces and outputs the host selecting control signal to the selected transmission interface in step S507. Next, the selected transmission interface outputs the interface control signal to the light emitting module in step S509, and then step S515 is performed. If the light board does not support any type of the transmission interfaces indicated by the interface testing signals, the mainboard outputs the host selecting control signal to the lighting control module in step S511. Next, the lighting control module outputs the lighting control signal to the light emitting module according to the host selecting control signal in step S513, and then step S515 is performed.

In step S515, the one or more light emitting unit emit the light beam according to the received interface control signal or lighting control signal.

Figure 6:
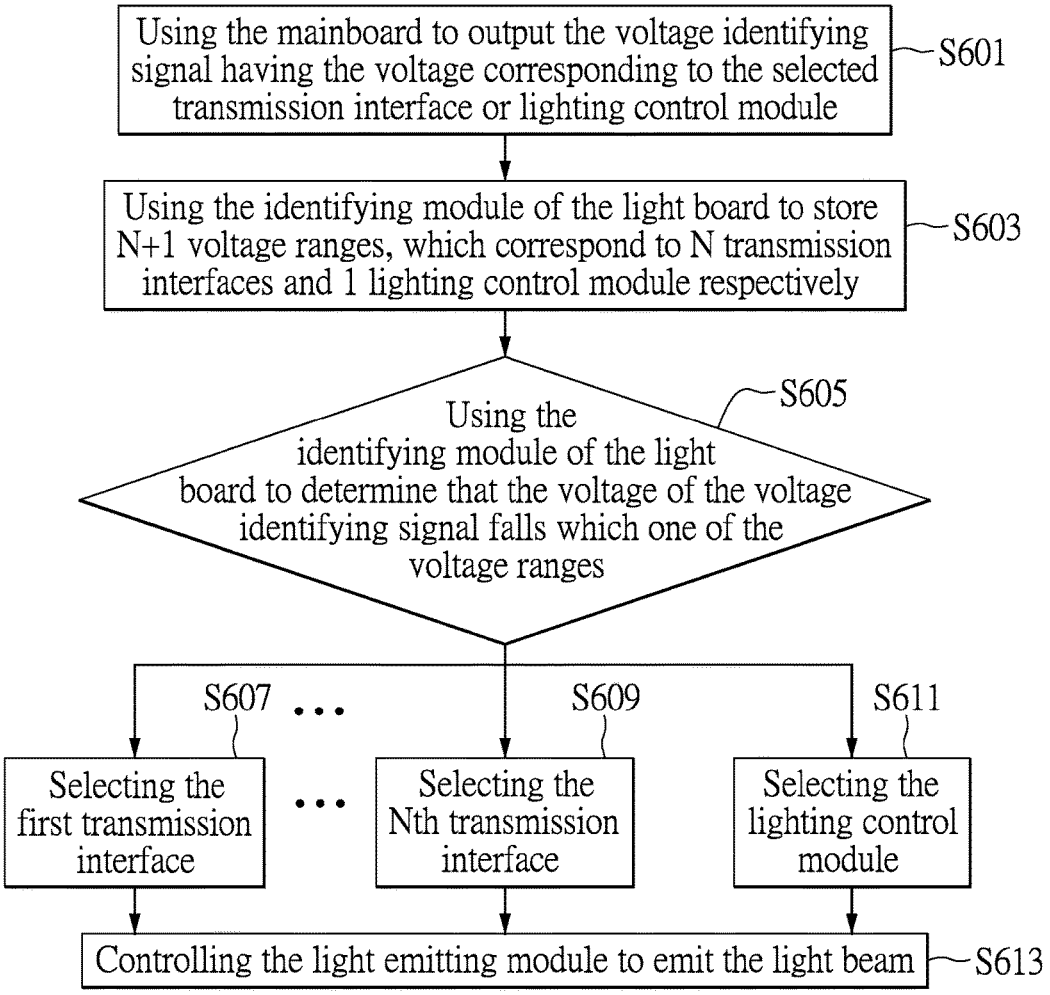
FIG. 6 is a flowchart of a lighting control method according to a fourth embodiment of the present disclosure.

Reference is made to FIG. 6, which is a flowchart of a lighting control method according to a fourth embodiment of the present disclosure. As shown in FIG. 6, the lighting control method of the fourth embodiment includes the following steps S601 to S613, which may be combined with any one or more of steps S501 to S515 of the third embodiment, for the lighting control system of the first and second embodiments.

In step S601, the mainboard selects one of the transmission interfaces and the lighting control module as the transmission medium, and then the mainboard outputs the voltage identifying signal having the voltage corresponding to the selected transmission medium to the identifying module of the light board.

In step S603, the identifying module of the light board stores N+1 voltage ranges, which correspond to N transmission interfaces and one lighting control module respectively.

In step S605, the identifying module determines which one of the transmission interfaces and the lighting control module is selected according to the voltage of the voltage identifying signal. More specifically, the identifying module compares the voltage of the voltage identifying signal with the N+1 voltage ranges that respectively correspond to the N transmission interfaces and the one lighting control module to determine which one of the N+1 voltage ranges the voltage of the voltage identifying signal falls in, thereby determining which one of the transmission interfaces and the lighting control module is selected by the mainboard. Then, the identifying module outputs the identifying signal to the selected transmission interface or lighting control module to indicate the selected transmission interface or lighting control module to control the light emitting module to emit the light beam. It should be understood that, in practice, if the mainboard determines that the operating states of the different circuit components are needed to be displayed synchronously by the light emitting modules, more than one transmission mediums may be selected.

In summary, the present disclosure provides a lighting control system and method, which drive the light emitting units as the status indicators to emit the light beams, for example, by using the various interfaces such as the SMBUS interface and the USB interface supported by the light board and the lighting control system of the light board, according to the operational states of the circuit components such as a solid state disk in a computer host. Therefore, the present disclosure has an advantage of wide compatibility between the mainboard and the light board.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A lighting control system, comprising:

a light board including:

a light emitting module including one or more light emitting units each configured to emit a light beam according to a received interface control signal or a received lighting control signal;

a plurality of transmission interfaces connected to the light emitting module, wherein each of the transmission interfaces responds to an interface message signal according to transmission interface information inquired by a received interface testing signal, and when one of the transmission interfaces receives a host selecting control signal, the one transmission interface outputs the interface control signal to the light emitting module to control the light emitting module to emit the light beam;

a lighting control module connected to the light emitting module, when the lighting control module receives the host selecting control signal, the lighting control module outputs the lighting control signal to the light emitting module according to the host selecting control signal to control the light emitting module to emit the light beam; and a mainboard connected to the transmission interfaces and the lighting control module, wherein the mainboard outputs the interface testing signals to the transmission interfaces respectively to inquire the transmission interface information of the transmission interfaces, when the mainboard determines whether the light board supports one or more types of transmission interfaces indicated by the interface testing signals according to the interface message signals, the mainboard selects one of the supported transmission interfaces and outputs the host selecting control signal to the selected transmission interface, and when the mainboard determines that the light board does not support any type of the transmission interfaces indicated by the interface testing signals according to the interface message signals, the mainboard outputs the host selecting control signal to the lighting control module.

2. The lighting control system of claim 1, wherein the light board further includes an identifying module connected to the mainboard, the transmission interfaces and the lighting control module, wherein the identifying module stores voltages which respectively correspond to the transmission interfaces and the lighting control module, the mainboard outputs a voltage identifying signal having the voltage corresponding to the selected transmission interface or lighting control module, and the identifying module determines the voltage of the voltage identifying signal and accordingly outputs an identifying signal to the transmission interface or the lighting control module that is selected by the mainboard to indicate the selected transmission interface or lighting control module to control the light emitting module to emit the light beam.

3. The lighting control system of claim 1, wherein the light board further includes an identifying module connected between the mainboard and the transmission interfaces and between the mainboard and the lighting control module, the mainboard outputs a voltage identifying signal having a voltage falling within a voltage range corresponding to the selected transmission interface or lighting control module, and the identifying module determines the voltage range where the voltage of the voltage identifying signal falls in to further determine the transmission interface or the lighting control module selected by the mainboard.

4. The lighting control system of claim 1, wherein the transmission interfaces includes an SMBUS/I2C transmission interface, a USB transmission interface or a combination thereof.

5. A lighting control method, comprising the steps of:

using a mainboard to output interface testing signals to a plurality of transmission interfaces of a light board to inquire transmission interface information of the transmission interfaces;

using the transmission interfaces of the light board to respond interface message signals to the mainboard according to the transmission interface information inquired by the interface testing signals;

using the mainboard to determine whether the light board supports one or more types of transmission interfaces indicated by the interface testing signals according to the interface message signals; if the light board supports one or more types of transmission interfaces indicated by the interface testing signals, using the mainboard to select one of the supported transmission interfaces and output a host selecting control signal to the selected transmission interface, and using the selected transmission interface to output an interface control signal according to the host selecting control signal to a light emitting module; if the light board does not support one or more types of transmission interfaces indicated by the interface testing signals, using the mainboard to output the host selecting control signal to a lighting control module, and using the lighting control module to output a lighting control signal to the light emitting module; and using the light emitting module to emit a light beam according to the received interface control signal or the lighting control signal.

6. The lighting control method of claim 5, further comprising the steps of:

using an identifying module of the light board to store voltages, which respectively correspond to the transmission interfaces and the lighting control module;

using the mainboard to output a voltage identifying signal having the voltage corresponding to the selected transmission interface or lighting control module; and using the identifying module of the light board to determine the voltage of the voltage identifying signal and accordingly output an identifying signal to the transmission interface or the lighting control module that is selected by the mainboard to indicate the selected transmission interface or lighting control module to control the light emitting module to emit the light beam.

7. The lighting control method of claim 5, further comprising the steps of:

using an identifying module of the light board to store voltage ranges, which respectively correspond to the transmission interfaces and the lighting control module;

using the mainboard to output a voltage identifying signal having a voltage falling within one of the voltage ranges that corresponds to the selected transmission interface or lighting control module; and using the identifying module of the light board to determine the voltage range where the voltage of the voltage identifying signal falls in to output an identifying signal to the selected transmission interfaces or lighting control module to indicate the selected transmission interface or lighting control module to control the light emitting module to emit the light beam.

* * * * *